US009188945B2

(12) United States Patent
Anan et al.

(10) Patent No.: US 9,188,945 B2
(45) Date of Patent: Nov. 17, 2015

(54) CARTRIDGE AND IMAGE FORMING APPARATUS

(75) Inventors: Osamu Anan, Susono (JP); Akihiro Fujiwara, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 292 days.

(21) Appl. No.: 13/597,391

(22) Filed: Aug. 29, 2012

(65) Prior Publication Data

US 2013/0058675 A1 Mar. 7, 2013

(30) Foreign Application Priority Data

Sep. 5, 2011 (JP) ..... 2011-192528

(51) Int. Cl.
*G03G 15/00* (2006.01)
*G03G 21/16* (2006.01)
*G03G 21/18* (2006.01)

(52) U.S. Cl.
CPC ..... *G03G 21/1652* (2013.01); *G03G 21/1871* (2013.01)

(58) Field of Classification Search
CPC ..... G03G 21/1652; G03G 21/1867; G03G 21/1871
USPC ..... 399/90, 111, 271
See application file for complete search history.

(56) References Cited

U.S. PATENT DOCUMENTS

| | | | | |
|---|---|---|---|---|
| 7,099,607 | B2 | 8/2006 | Suzuki et al. | |
| 7,136,604 | B2 | 11/2006 | Chadani et al. | |
| 7,215,909 | B2 | 5/2007 | Nittani et al. | |
| 7,366,439 | B2 | 4/2008 | Anan et al. | |
| 7,720,412 | B2 | 5/2010 | Anan et al. | |
| 8,095,036 | B2 | 1/2012 | Yoshino et al. | |
| 8,155,553 | B2 | 4/2012 | Takarada | |
| 8,160,477 | B2 | 4/2012 | Anan et al. | |
| 8,594,526 | B2 | 11/2013 | Mushika et al. | |
| 2001/0041080 | A1* | 11/2001 | Higeta et al. | 399/103 |
| 2003/0012588 | A1* | 1/2003 | Suzuki et al. | 399/281 |

(Continued)

FOREIGN PATENT DOCUMENTS

| | | | |
|---|---|---|---|
| CN | 1648789 | A | 8/2005 |
| CN | 1763638 | A | 4/2006 |
| CN | 102163029 | A | 8/2011 |

OTHER PUBLICATIONS

Office Action in Chinese Patent Application No. 201210325423.1, dated Mar. 31, 2014 (with English translation).

*Primary Examiner* — David Gray
*Assistant Examiner* — Thomas Giampaolo, II
(74) *Attorney, Agent, or Firm* — Fitzpatrick, Cella, Harper & Scinto

(57) ABSTRACT

A cartridge includes: a rotatable member, including a metal shaft, supported movably in an axial direction of the metal shaft; an electroconductive member, supported movably in the axial direction in contact to an end surface of the metal shaft in one end side of the metal shaft, for constituting an electroconductive path for electrically connecting the metal shaft and a contact member provided in an image forming apparatus main assembly; an urging portion for urging the metal shaft via the electroconductive member in a direction from the one end side to another end side of the metal shaft; and an abutting portion for positioning the rotatable member by being abutted by the metal shaft. The electroconductive member includes a contact portion to the end surface of the metal shaft, at a portion other than a rotation center portion of the metal shaft at the end surface.

17 Claims, 7 Drawing Sheets

(56) References Cited

U.S. PATENT DOCUMENTS

| | | | | |
|---|---|---|---|---|
| 2003/0228173 | A1 | 12/2003 | Nittani et al. | |
| 2005/0201772 | A1* | 9/2005 | Ishii et al. | 399/90 |
| 2006/0269313 | A1* | 11/2006 | Takagi | 399/90 |
| 2007/0166070 | A1 | 7/2007 | Sato | |
| 2011/0013925 | A1* | 1/2011 | Kim et al. | 399/90 |
| 2011/0142487 | A1 | 6/2011 | Anan et al. | |
| 2011/0229196 | A1 | 9/2011 | Kawai et al. | |

* cited by examiner

CARTRIDGE AND IMAGE FORMING APPARATUS

FIELD OF THE INVENTION AND RELATED ART

The present invention relates to a cartridge detachably mountable to an apparatus main assembly of an image forming apparatus for forming an image on a recording material (medium).

The image forming apparatus forms the image on the recording material by using an image forming process such as an electrophotographic process, an electrostatic recording process or a magnetic recording process. Examples of the image forming apparatus may include a copying machine, a printer (LED printer, laser beam printer or the like), a facsimile machine, a word processor and a multi-function machine of the these machines.

The recording material is a material on which the image is formed by the image forming apparatus, and it is a paper sheet, an OHT sheet, or the like.

For example, the cartridge is a process cartridge or a developing cartridge, and in a state in which it is detachably mountable to the apparatus main assembly of the image forming apparatus, it contributes to an image forming process for forming the image on the recording material. The apparatus main assembly refers to an apparatus constituent portion excluding the cartridge from the constitution of the image forming apparatus.

The process cartridge is prepared by integrally assembling an image bearing member on which a latent image to be formed and at least one of a charging means, a developing means, a cleaning means as process means, into a cartridge, and is detachably mountable to the apparatus main assembly. The image bearing member is an electrophotographic photosensitive member an electrostatic recording dielectric member, a magnetic recording magnetic member, etc.

The process means acts on the image bearing member. The process cartridge can be mounted and demounted relative to a main assembly of the image forming apparatus by a user himself(herself). For this reason, the maintenance of the apparatus main assembly is easy. Therefore, the process cartridge include a cartridge prepared by integrally assembling the developing means as the process means and the image bearing member and being detachably mountable to the apparatus main assembly. The process cartridge which includes the image bearing member and the developing means integrally is called an integral type. Further, the process cartridge which includes the image bearing member and the process means other than the developing means integrally is called the discrete type. That is, the developing means is provided in a developing unit separated from the process cartridge, and the process cartridge, for forming the image, paired up with the developing unit is referred to as the so-called discrete type.

Further, the developing cartridge includes a developing roller (developer carrying member) and accommodates a developer (toner) used by the developing roller for developing the latent image formed on the image bearing member, and is detachably mountable to the apparatus main assembly. Also the developing cartridge is detachably mountable to the apparatus main assembly by the user himself (herself). For this reason, the maintenance of the apparatus main assembly can be easily performed.

In the case of the developing cartridge, the image bearing member is mounted to the apparatus main assembly or a cartridge supporting member. Or, the image bearing member is provided in the so-called discrete type process cartridge (in this case, the process cartridge does not include the developing means).

Therefore, as for the cartridge, the integral type process cartridge and the discrete type process cartridge are included. Further, the cartridge includes the case where the discrete type process cartridge and the developing cartridge are used in a pair. Further, the cartridge includes the case where the developing cartridge, in which the image bearing member is fixed to the apparatus main assembly or the cartridge supporting member, which is actable on the image bearing member and is detachably mountable to the image bearing member. Further, the cartridge includes a developing cartridge which accommodates the developer (toner) to be supplied to the process cartridge, the developing cartridge, or the like.

For convenience, the electrophotographic image forming apparatus will be described as an example. In the image forming apparatus such as the printer using the electrophotographic process, the photosensitive drum which is the image bearing member is electrically charged uniformly and is subjected to selective exposure to light to form the latent image. Then, the latent image is visualized (developed) with the toner as the developer, and a resultant toner image is transferred onto the recording material and then is subjected to application of heat and pressure to be fixed on the recording material, so that image recording (image formation) is effected (formed).

Such an apparatus is subjected to toner supply or maintenance of various process means. For this reason, as a means for facilitating a toner supplying operation or the maintenance, a cartridge type has been put into practical use. According to this cartridge type, the maintenance of the apparatus can be performed by a user himself (herself), so that operativity could be remarkably improved. Therefore, the cartridge type has been widely used in the image forming apparatus.

Further, in recent years, a color image forming apparatus for forming a color image by using develops of a plurality of colors has been popularized. As the color image forming apparatus, a so-called in-line type image forming apparatus in which photosensitive drums corresponding to image forming operations using toners of the plurality of colors are disposed in line along a surface movement direction of a toner image receiving member onto which the toner image is to be transferred has been known.

In the color image forming apparatus of the in-line type, there is an apparatus in which the plurality of photosensitive members are disposed in line with respect to a direction (e.g., a horizontal direction). The in-line type is a preferably image forming type in terms of easy response to demands such as speed-up of an image forming speed and development to a multi-function printer.

In the cartridge, in general, a developing device frame for supporting the developing means, is provided with a developing roller, as the developing means, including a metal shaft and an electroconductive rubber member, and a developing blade as a developer regulating member with respect to a longitudinal direction. Further, on a side surface of the developing device frame, a gear train for rotationally driving the developing roller and an electroconductive member for applying a bias to the developing roller are provided. In the cartridge including such an electroconductive member, in order to stably effect bias application to the rotationally driven developing roller, a constitution in which the electroconductive member is contacted to an end surface of the metal shaft of the developing roller has been proposed (FIG. 1 of U.S. Pat. No. 7,215,909).

Further, in general, the developing roller has a clearance (play) for absorbing contraction of the frame due to an environmental fluctuation and tolerance of individual parts and therefore is movable in the longitudinal direction. For this reason, in order to prevent trace of abrasion with a developing blade due to vibration during transportation or the like, an urging member for urging the developing roller in one direction of the longitudinal direction is provided (FIGS. 4 and 10 of U.S. Pat. No. 8,155,553).

In the constitution in which the electroconductive member is contacted to the metal shaft end surface of the developing roller and then the bias application is effected, during machining (processing) of the metal shaft, a protrusion remaining at the center of the end surface as a. trace of cutting of a rotation center of a cutting tool is generated. For that reason, there was a need to effect the machining for removing the protrusion at the metal shaft end surface in order to stabilize electroconduction.

Further, compared with a contact (point) pressure of the electroconductive member necessary to apply the bias to the developing roller, an urging force of an urging member necessary to urge the developing roller in the longitudinal direction is large and therefore there was a need to provide the urging member, with respect to the longitudinal direction, separately from the electroconductive member.

SUMMARY OF THE INVENTION

A principal object of the present invention is to provide a cartridge and an image forming apparatus which are capable of using a contact pressure of an electroconductive member, for bias application to a metal shaft end surface of a rotatable member such as a developing roller, as an urging force of an urging member for urging the rotatable member in one direction of a longitudinal direction. Another object of the present invention is to provide the cartridge and the image forming apparatus which are capable of effecting stable bias application from the metal shaft end surface even with no machining for removing a residual protrusion at the metal shaft end surface of the rotatable member such as the developing roller.

According to an aspect of the present invention, there is provided a cartridge detachably mountable to a main assembly of an image forming apparatus for forming an image on a recording material, the cartridge comprising: a rotatable member, including a metal shaft, supported rotatably by and movably in an axial direction of the metal shaft by a frame, wherein a bias is to be applied to the metal shaft; an electroconductive member, supported movably in the axial direction of the metal shaft in contact to an end surface of the metal shaft in one end side of the metal shaft, for constituting at least a part of an electroconductive path for electrically connecting the metal shaft and a contact member provided in the main assembly when the cartridge is mounted in the main assembly; an urging portion for urging the metal shaft via the electroconductive member in a direction from the one end side to another end side of the metal shaft; and an abutting portion for positioning the rotatable member with respect to the axial direction by being abutted by the metal shaft by an urging force of the urging member, wherein the electroconductive member includes a contact portion, where the electroconductive member is contacted to the end surface of the metal shaft, at a portion other than a rotation center portion of the metal shaft at the end surface.

According to the present invention, in order to ensure the contact pressure of the electroconductive member for bias application to the rotatable member to which the bias is to be applied, the urging force of the urging member for urging the rotatable member in the longitudinal direction can be used. Further, even when the metal shaft of the rotatable member is not subjected to protrusion-removing machining, it is possible to effect stable bias application from the metal shaft end surface.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

A color electrophotographic image forming apparatus using a cartridge according to the present invention will be described below with reference to the drawings.

(Embodiment 1)

<General Structure of Image Forming Apparatus>

Figure 2:
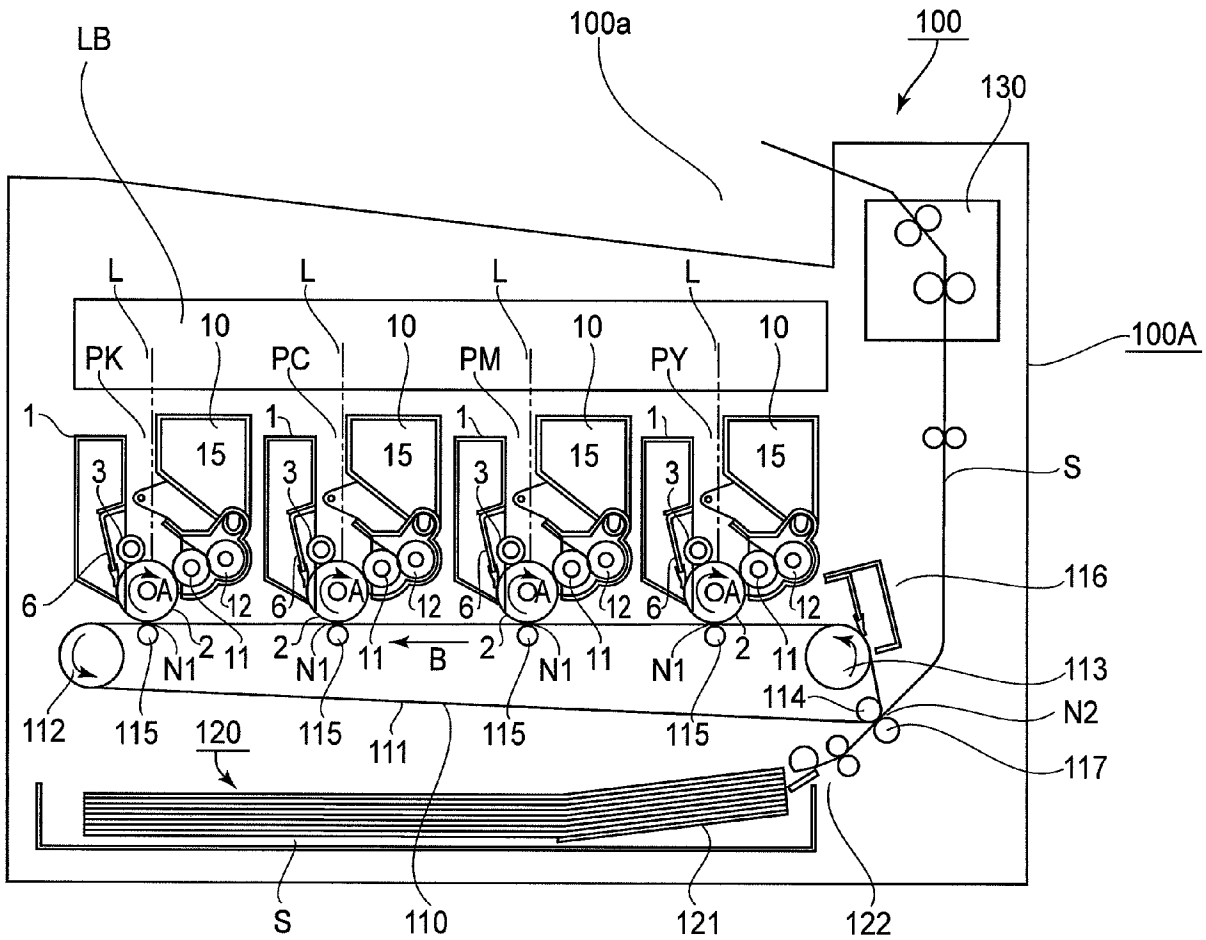
FIG. 2 is a schematic sectional view showing an example of a color electrophotographic image forming apparatus in Embodiment 1.
Figure 3:
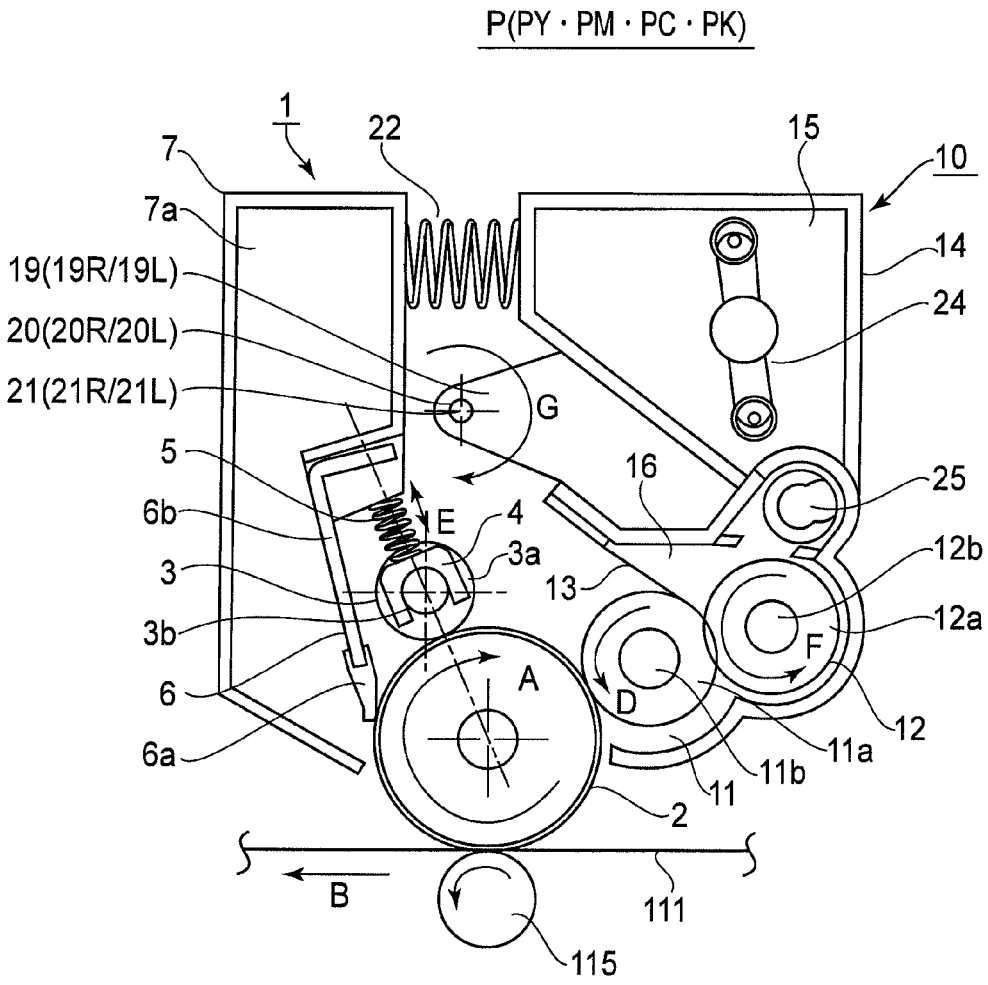
FIG. 3 is a principal sectional view of a cartridge.

First, a general structure of an example of the image forming apparatus will be described with reference to FIGS. 2 and 3. FIG. 2 is a schematic sectional view showing an example of the color electrophotographic image forming apparatus. FIG. 3 is a principal sectional view of a process cartridge.

An image forming apparatus 100 shown in FIG. 2 is a four color-based full-color laser printer using an electrophotographic process and effects image formation on a recording material S. The image forming apparatus 100 is of a process cartridge type in which first to fourth process cartridges P (PY, PM, PC, PK) for four colors are juxtaposed from left to right in the horizontal direction. Each of the process cartridges P is detachably mountable to a predetermined mounting portion of an apparatus main assembly 100A in a predetermined manner.

The respective process cartridges P have similar electrophotographic process mechanisms and are different in color of developers and in filling amount of the developers. To each process cartridge P, a rotational driving force is transmitted from the apparatus main assembly 100A side. Further, to each process cartridge P, a bias or voltage (charging bias, developing bias or the like) is applied from the apparatus main assembly 100A side.

Each process cartridge P in this embodiment is constituted by a cleaning unit 1 and a developing unit 10. The cleaning unit 1 includes an electrophotographic photosensitive drum 2 as an image bearing member (hereinafter referred to as a photosensitive drum) and, as process means, a charging roller 3 and a cleaning member 6 which act on the photosensitive drum 2. The developing unit 10 includes a developing means for developing an electrostatic latent image formed on the photosensitive drum 1. The cleaning unit 1 and the developing unit 10 are swingably connected with each other.

The first process cartridge PY accommodates the developer (non-magnetic one-component developer: toner) of yellow (Y) in a developer accommodating portion 15 and forms the developer image of yellow (Y) on the surface of the photosensitive drum 2. Similarly, the second process cartridge PM accommodates the developer of magenta (M), the third process cartridge PC accommodates the developer of cyan (C), and the fourth process cartridge PK accommodates the developer of black (K).

Above each of the cartridges P, a laser scanner unit LB as an exposure means is disposed. The laser scanner unit LB outputs laser light L correspondingly to image information. The surface of the photosensitive drum 2 is subjected to scanning exposure to the laser light L.

Under each process cartridge P, an intermediary transfer belt unit 110 as a primary transfer member is disposed. This intermediary transfer belt unit 110 includes a flexible endless transfer belt 111 and rollers, for stretching and rotating the transfer belt 111, consisting of a driving roller 112, a follower roller 113 and a secondary transfer opposite roller 114. The photosensitive drum 2 of each process cartridge P is contacted to the transfer belt 12 111. A contact portion N1 between the photosensitive drum 2 and the transfer belt 111 is a primary transfer portion. Inside the transfer belt ill, primary transfer rollers 114 are disposed opposed to the associated photosensitive drums 2. At a position opposing the secondary transfer opposite roller 114, a secondary transfer roller 117 as a secondary transfer means is disposed. A contact portion N2 between the transfer belt 111 and the secondary transfer roller 17 is a secondary transfer portion.

Below the intermediary transfer belt unit 110, a sheet feeding unit 120 is disposed. The sheet feeding unit 120 includes a sheet feeding tray 120 in which sheets of the recording material S are accommodated and includes a sheet feeding roller 122.

In an upper right side of the apparatus main assembly 100A, a fixing unit 130 is disposed. An upper surface of the apparatus main assembly 100A constitutes a sheet discharge tray 100*a*.

<Image Forming Operation>

An operation for forming a full-color image is as follows. The photosensitive drums 2 of the first to fourth process cartridges P (PY, PM, PC, PK) are rotationally driven in an arrow A direction at a predetermined speed. The transfer belt 111 is rotationally driven in an arrow B direction (codirectionally with the photosensitive drums at their contact portions). At this time, a speed of the transfer belt 111 corresponds to the speed of the photosensitive drums 2. Similarly, the laser scanner unit LB is driven.

In synchronism with the drive of the laser scanner unit LB, the surface of the photosensitive drum 2 of each process cartridge P is uniformly charged to a predetermined polarity and a predetermined potential by the charging roller 3. The laser scanner unit LB scans and exposes the surface of each photosensitive drum 2 with the laser light L depending on an image signal for an associated color. As a result, an electrostatic latent image depending on the image signal for the associated color is formed on the surface of each photosensitive drum 2. The thus formed electrostatic latent image is developed by the developing roller 11.

By the above-described image forming operation, on the photosensitive drum 2 of the first process cartridge PY, a yellow (Y) developer image is formed. Then, the Y developer image is primary-transferred onto the transfer belt 111.

Similarly, the developer images of the second process cartridge PM, the third process cartridge PC and the fourth process cartridge PK are superposed on the transfer belt 111, so that unfixed toner images for a four color-based full-color image are formed. In each process cartridge P, the developer remaining on the surface of the photosensitive drum 2 after the primary transfer is removed by the cleaning member 6.

On the other hand, with predetermined control timing, the recording material S is fed and introduced into the secondary transfer nip N2, in which the four color developer images superposed on the transfer belt 111 are collectively transferred onto the surface of the recording material S. The recording material S coming out of the secondary transfer nip N2 is separated from the surface of the transfer belt 111 and then is introduced into the fixing unit 130. Then, the recording material S is heated and pressed at a fixing nip portion. As a result, the developer images are fixed on the recording material S. Thereafter, the recording material S already subjected to the fixing is conveyed onto the sheet discharge tray 100*a*, so that the full-color image forming operation is completed.

Further, the developer remaining on the surface of the transfer belt 111 after the secondary transfer is removed by a cleaning device 116.

<General Structure of Process Cartridge>

Figure 4:
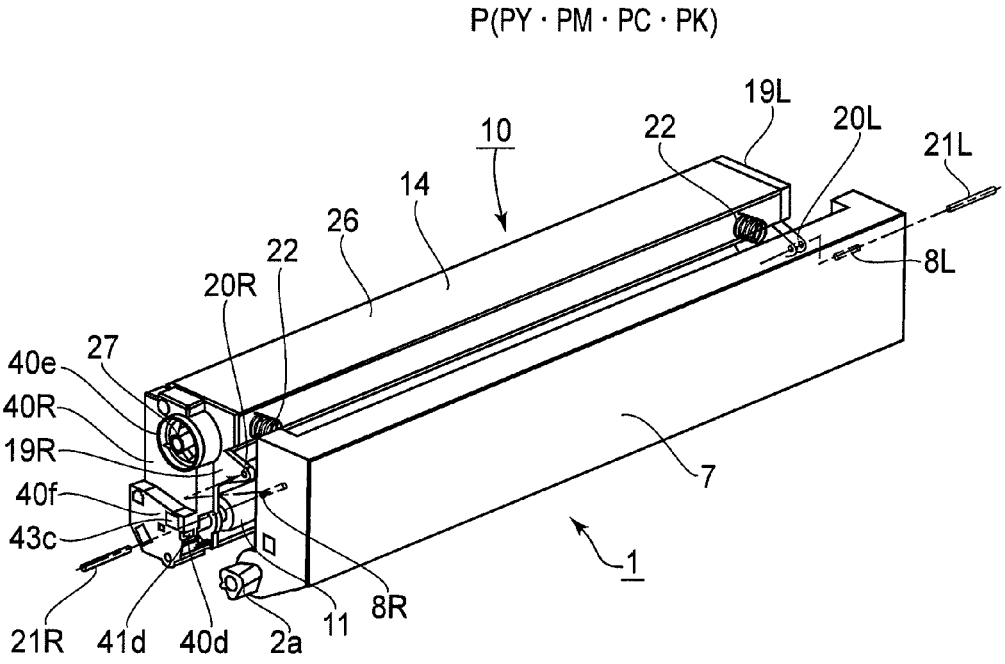
FIG. 4 is an exploded perspective view of a cleaning unit and a developing unit of the cartridge.

Next, a general structure of the process cartridge P will be described with reference to FIGS. 3 and 4. FIG. 4 is an exploded perspective view of the cleaning unit 1 and the developing unit 10 of the process cartridge P. In the following description, with respect to the process cartridge P or process cartridge constituent members, a rotational axis direction (axial direction) of the photosensitive drum 2 is a longitudinal direction, and a direction perpendicular to the rotational axis direction is a widthwise direction.

1) Cleaning Unit 1

Each process cartridge P is formed from the cleaning unit 1 and the developing unit 10. First, the cleaning unit 1 will be described. The cleaning unit 1 includes a cleaning (device) frame 7 constituting a framework of the unit or the cartridge, and includes the photosensitive drum 2, the charging roller 3 and the cleaning member 6.

The photosensitive drum 2 is rotatably supported between side plates of the cleaning frame 7 in one end side (driving side) and another end side (non-driving side) with respect to the longitudinal direction. In one end side of the photosensitive drum 2, as shown in FIG. 4, a drum driving coupling 2*a* is provided. The photosensitive drum 2 and the drum driving coupling 2*a* are integrally formed.

The drum driving coupling 2*a* engages with a coupling (not shown) of the apparatus main assembly 100A side in a state in which the cartridge P is mounted in the apparatus main assembly 100A in a predetermined manner. A driving force of a driving motor (not shown) in the side of the apparatus main assembly 100A is transmitted to the drum driving coupling 2*a*, so that the photosensitive drum 2 is rotationally driven in the arrow A direction at the predetermined speed.

The charging roller 3 is formed by an electroconductive rubber portion 3*a* and a metal shaft 3*b* and is disposed in parallel to the photosensitive drum 2, and is rotated by the rotation of the photosensitive drum 2 while being contacted to the photosensitive drum 2. The charging roller 3 is, as shown in FIG. 3, mounted to the cleaning frame 7 via a charging roller bearing 4. The charging roller 3 is mounted movably in an arrow E direction along a line connecting the rotation center of the charging roller 3 and the rotation center of the photosensitive drum 2. The rotation shaft (metal shaft) 3*b* of the charging roller 3 is rotatably supported by the charging roller bearing 4. The charging roller bearing 4 is urged toward the photosensitive drum 2 by a charging roller pressing member (elastic urging member) 5.

The cleaning member 6 is constituted by an elastic rubber blade 6*a* at its end and a supporting metal plate 6*b*. The end of the elastic rubber blade 6*a* is contacted to the photosensitive drum 2 with respect to a counter direction to the rotational direction A of the photosensitive drum 2. The cleaning member 6 removes the developer remaining on the photosensitive drum 2. The developer removed from the peripheral surface of the photosensitive drum 2 is accommodated in a removed developer accommodating portion 7*a* of the cleaning frame 7.

2) Developing unit 10

Next, the developing unit 10 will be described. The developing unit 10 includes a developing (device) frame 14, constituting a frame work of the unit or the cartridge, for supporting respective elements in the developing unit 10. The developing frame 14 is divided into a developing portion 16 and a developer accommodating portion 15.

At the developing portion 16, a developing roller 11, a developer supplying roller 12 and a developing blade 13 are provided. The developing roller 11 is a developer carrying member (rotatable member) which is rotationally driven in an arrow D direction in contact to the photosensitive drum 2 to develop the latent image formed on the photosensitive drum 2 by supplying the developer to the latent image. The developing roller 11 is formed by an electroconductive rubber portion 11*a* and a metal shaft 11*b* and is rotatably supported between a development side plate 19R in one end side (driving side) of the developing frame 14 and a development side plate 19L in another end side (non-driving side) of the developing frame 14.

The supplying roller 12 is a developer supplying member which is rotationally driven in an arrow F direction in contact to the developing roller 11 as shown in FIG. 3 to supply the developer. The supplying roller 12 is formed by an elastic sponge portion 12*a* and a metal shaft 12*b*. The supplying roller 12 is caused to enter the developing roller 11 in a predetermined manner to be disposed in contact and parallel to the developing roller 11, and is rotatably supported between the development side plates 19R and 19L in one end side and another end side of the developing frame 14.

The developing blade 13 is a developer layer thickness regulating member for regulating a layer thickness of the developer on the developing roller 11 and is flexible member which rubs the developing roller 11 with its end portion to regulate the layer thickness of the developer applied onto the developing roller 11 and which is formed of phosphor bronze, urethane rubber or the like. The developing blade 13 is provided over the longitudinal direction of the developing roller 11 while being fixed to the developing frame 14 at its base portion.

In the developer accommodating portion 15, the developer and developer feeding members 24 and 25 are accommodated. Outside the development side plate 19R in one end side of the developing frame 14, a driving mechanism portion M (FIG. 5) of the developing unit 10 is provided and to which a side cover 40R for covering the driving mechanism portion M is mounted. Further, also outside of the development side plate 19L in another end side of the developing frame 14, a side cover (not shown) is mounted.

During development, the developer in the developer accommodating portion is fed to the supplying roller 12 by the developer feeding members 24 and 25. Then, the supplying roller 12 rotating in an arrow F direction supplies the toner to the developing roller 11 by rubbing the developing roller 11 rotating in the arrow D direction to cause the developing roller 11 to carry the developer thereon. The developer carried on the developing roller 11 reaches the place of the developing blade 13 with the rotation of the developing roller 11, so that the developing blade 13 regulates the developer in a predetermined thin layer.

The layer thickness-regulated developer is conveyed to a contact portion (developing portion) between the developing roller 11 and the photosensitive drum 2 by further rotation of the developing roller 11. Further, by a predetermined developing bias applied from a power (voltage) source (not shown) in the side of the apparatus main assembly 100A to the developing roller 11, the developer is deposited on the electrostatic latent image formed on the surface of the photosensitive drum 2, so that the latent image is developed. Incidentally, details of an electroconductive path for permitting application of the developing bias to the developing roller 11 will be described later.

3) Connection Between Cleaning Unit 1 and Developing Unit 10

Next, a connection between the cleaning unit 1 and the developing unit 10 will be described. As shown in FIG. 4, in one end side and another end side of the cleaning frame 14 of the cleaning unit 1, connecting holes 8 (8R, 8L) are provided. Further, the development side plates 19R and 19L in one end side and another end side of the developing frame 14 of the developing unit 10 are provided with development connecting holes 20 (20R, 20L).

Then, in one end side of the cleaning frame 7 and the developing frame 14, the cleaning connecting hole 8R and the development connecting hole 20R are aligned with each other and then a connecting shaft 21R is inserted. Further, in another end side of the cleaning frame 7 and the developing frame 14, the cleaning connecting hole 8L and the development connecting hole 20L are aligned with each other and then a connecting shaft 21L is inserted. As a result, the cleaning unit 1 and the developing unit 10 are connected swingably about the connecting shafts 21 (21R, 21L).

Between the thus-connected cleaning unit 1 and developing unit 10, as shown in FIGS. 3 and 4, a pressing spring (tension spring) 22 is disposed. By an urging force of this pressing spring 22, the developing unit 10 obtains rotation moment about the connecting shafts 21 (21R, 21L) as the center with respect to an arrow G direction. As a result, the developing roller 11 is held in a state in which the developing roller 11 is contacted to the photosensitive drum 2 at predetermined pressure.

In each process cartridge P, in a state in which each process cartridge P is mounted in a mounting portion of the apparatus main assembly 100A, the cleaning unit 1 is positioned at a positioning portion of the apparatus main assembly 100A and is fixed by a fixing means. In the developing unit 10, the developing roller 11 is held in a state in which it is contacted to the photosensitive drum 2 at the developing roller pressure by the rotation moment about the connecting shafts 21 (21R, 21L) as the center with respect to the arrow G direction generated by a spring force of the pressing spring 22.

In this embodiment, the developing roller 11 is contacted to the photosensitive drum 2 as a contact developing system. In one end side and another end side of the developing roller 11, spacer rollers each having an outer diameter larger than an outer diameter of the developing roller 11 by a predetermined length are provided coaxially with the developing roller 11. These spacer rollers are contacted to the photosensitive drum 2, so that it is possible to employ a constitution of a non-contact developing system in which the developing roller 11 is opposed to the photosensitive drum 2 with a predetermined gap in a non-contact manner and then the latent image is developed.

<Driving Constitution of Developing Unit>

Figure 5:
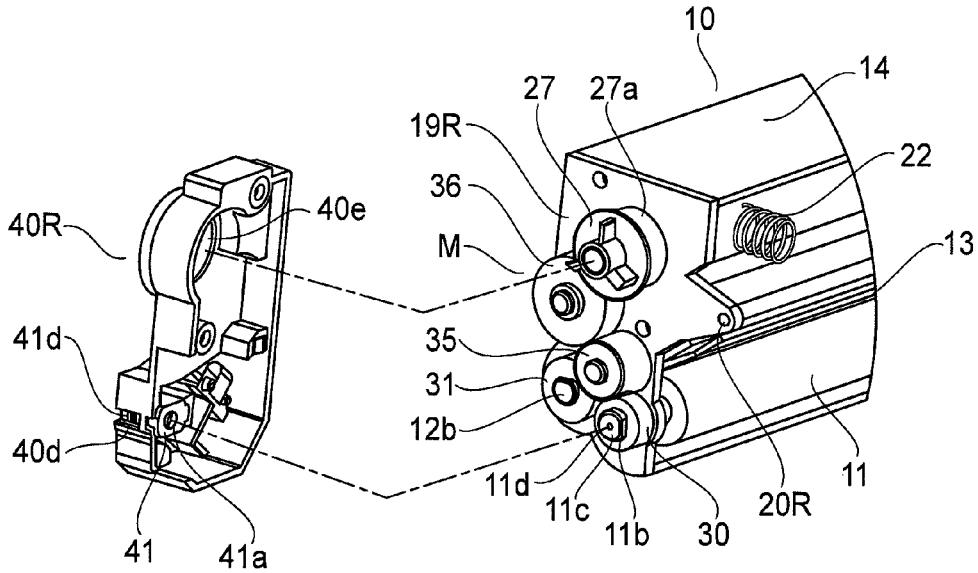
FIG. 5 is a perspective view showing a driving mechanism portion exposed by removing a side cover of the developing unit in one end side (driving side).

Next, a driving constitution of the developing unit 10 will be described with reference to FIGS. 4 and 5. FIG. 5 is a perspective view of the driving mechanism portion M exposed by removing the side cover 40R in one end side (driving side) of the developing unit 10. The metal shaft 11*b* of the developing roller 11 is projected from the development side plate 19R to the outside the one end side and at its projected shaft portion, a developing roller gear 30 for transmitting a driving force to the developing roller 11 is provided. Also the metal shaft 12*b* of the supplying roller 12 is projected from the development side plate 19R to the outside in one end side and at its projected shaft portion, a supplying roller gear 31 for transmitting a driving force to the supplying roller 12 is provided.

Further, outside the development side plate 19R, a development driving coupling 27 is provided. Further, a first idler gear 36 and a second idler gear 35 are provided. The first idler gear 36 engages with a gear portion 27*a* provided coaxially with the development driving coupling 27. The second idler gear 35 engages with the first idler gear 36. Both of the developing roller gear 30 and the supplying roller gear 31 engage with the second idler gear 35. The side cover 40R is mounted to the development side plate 19R, so that the driving mechanism portion M is covered.

However, the development driving coupling 27 faces an opening 40*e* provided in the side cover 40R. The development driving coupling 27 engages with the coupling (not shown) in the side of the apparatus main assembly 100A through the opening 40*e* of the side cover 40R. The development driving coupling 27 is rotated at a predetermined speed when the driving force of the driving motor (not shown) of the apparatus main assembly 100A is transmitted thereto.

The driving force of the driving motor in the apparatus main assembly 100A side is transmitted from the development driving coupling 27 through the following path. The driving force of the development driving coupling 27 is transmitted from the gear portion 27*a* to the developing roller gear 30 and the supplying roller gear 31 via the first idler gear 36 and the second idler gear 35. As a result, the developing roller 11 and the supplying roller 12 are driven.

Incidentally, drive of the developer feeding members 24 and 25 of the developer accommodating portion 15 is effected by transmitting the driving force of the development driving coupling 27 to the developer feeding members 24 and 25 via a speed-reducing gear mechanism (not shown) provided inside the development side plate 19R.

<Contact (Point) Constitution and Longitudinal Urging Constitution of Developing Roller>

Next, with reference to FIG. 1 and FIGS. 4 to 8, a constitution of an electroconductive path for permitting application of the developing bias to the developing roller 11 and a constitution in which the developing roller 11 is urged in one direction of the longitudinal direction in this embodiment will be described.

Figure 1:
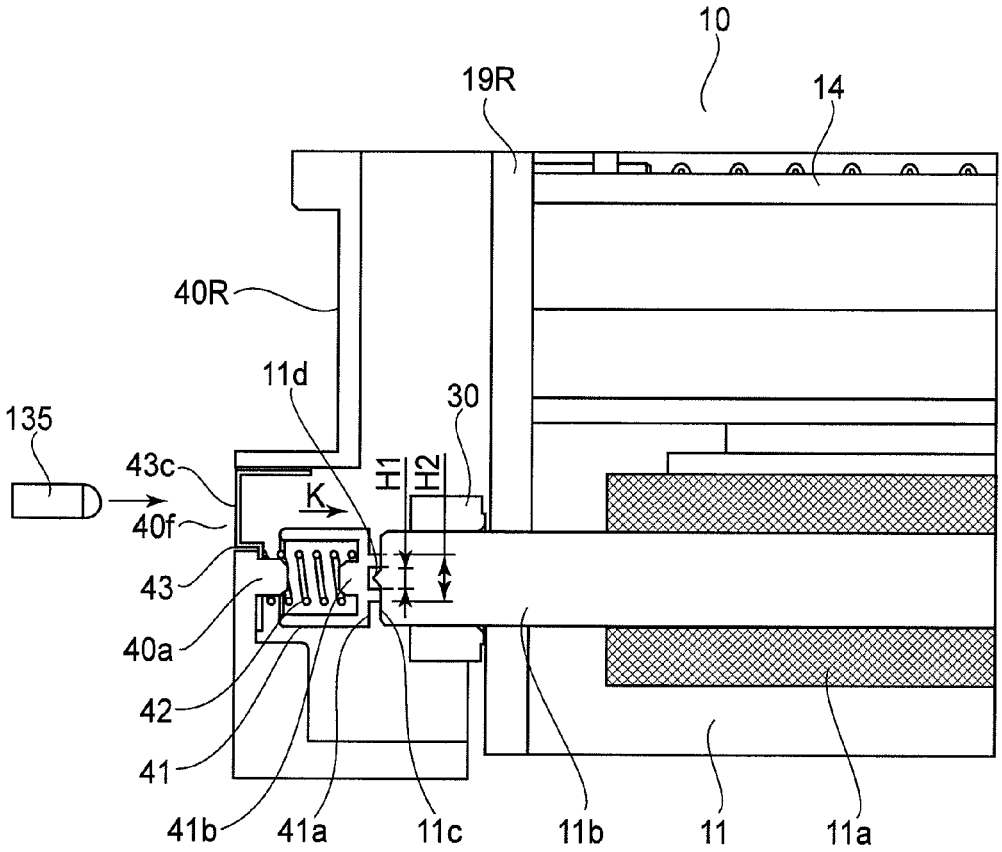
FIG. 1 is a partially sectional view, of a developing unit, showing a developing roller in one end side (driving side) in Embodiment 1.
Figure 6:
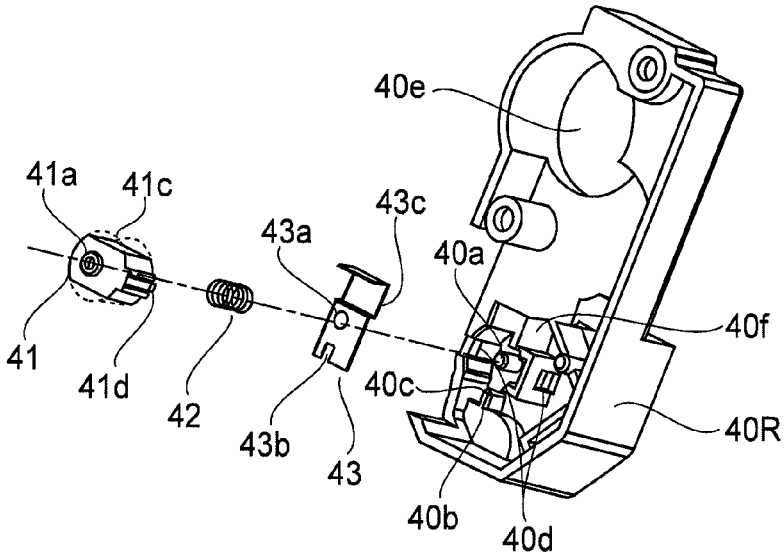
FIG. 6 is an exploded perspective view of o members incorporated inside the side cover.
Figure 7:
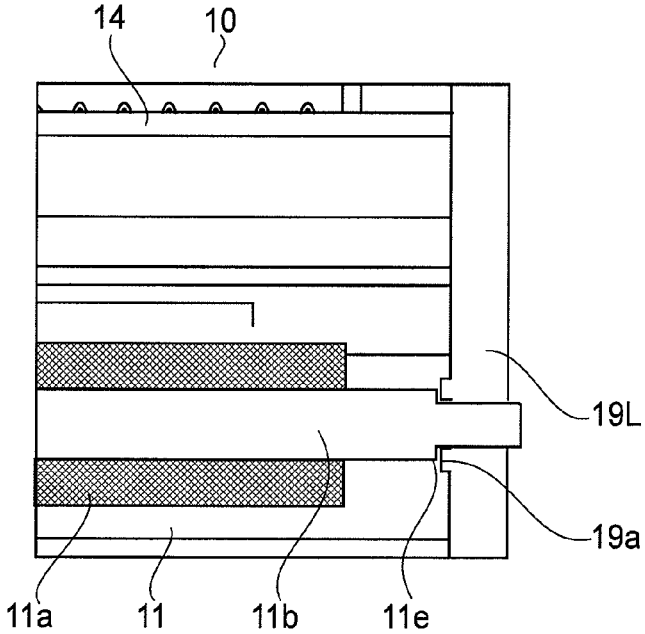
FIG. 7 is a partially sectional view of the developing unit, showing the developing roller in another end side (non-driving side).
Figure 8:
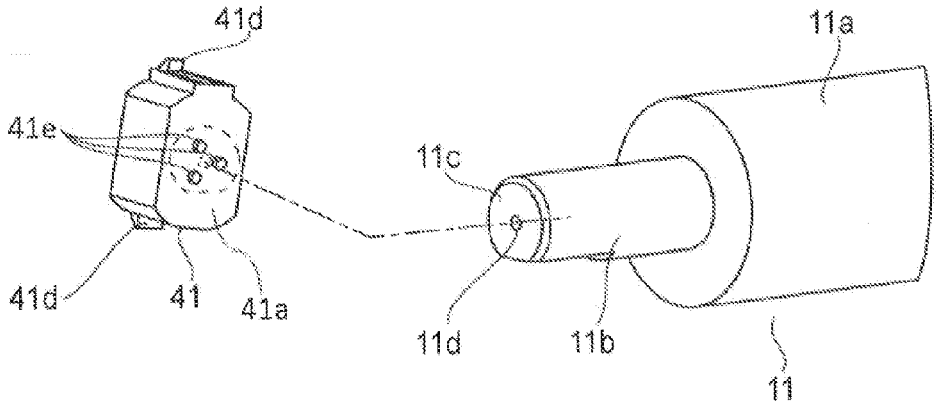
FIG. 8 is a partially perspective view, of the electroconductive member, showing a modified example of Embodiment 1.

FIG. 1 is a partially sectional view, of the developing unit 10, showing the developing roller 11 in one end side (driving side) in Embodiment 1. FIG. 6 is an exploded perspective view of o members incorporated inside the side cover 40R. FIG. 7 is a partially sectional view of the developing unit, showing the developing roller 11 in another end side (non-driving side). FIG. 8 is a partially perspective view, of the electroconductive member, showing a modified example of this embodiment.

The developing roller 11 is formed by the electroconductive rubber portion 11*a* and the metal shaft 11*b* and is supported rotatably between the development side plates 19R and 19L in one end side (driving side) and another end side (non-driving side) of the developing frame 14 and movable in the axial direction. On the other hand, as shown in FIG. 7, in another end side of the metal shaft 11*b* of the developing roller 11, a stepped portion 11*e* as a portion to be abutted is provided. Further, the development side plate 19L is provided with a receiving surface (abutting portion) 19*a* for the stepped portion 11*e*.

To the development side plate 19R in one end side of the developing unit 10, as shown in FIG. 4, the side cover 40R is mounted so as to cover the driving mechanism portion M. Further, as shown in FIGS. 1, 5 and 6, inside the side cover 40R, in order to apply the developing bias to the developing roller 11 and urge the developing roller 11 in one direction of the longitudinal direction, an electrode plate 43, an urging member 42 and an electroconductive member 41 are provided.

The electrode plate 43 is a member constituting a contact portion, to a contact (point) member (electrical contact (point) member) 135 (FIG. 1) provided in the side of the apparatus main assembly 100A, when the cartridge P is mounted in the apparatus main assembly 100A. The urging member 42 is a member for moving and urging the developing roller 11 in one direction of the longitudinal direction. In this embodiment, the urging member 42 is an electroconductive coil spring for moving and urging the developing roller 11 in a direction from one end side (driving side) to another end side (non-driving side). The electroconductive member 41 includes a contact portion 41*a* which contacts and slides on the end surface 11*c* of the metal shaft 11*b* of the developing roller 11 in one end side (driving side).

In this embodiment, the electrode plate 43, the urging member 42 and the electroconductive member 41 are assembled with the side cover 40R in the following procedure. First, a boss portion 40*a* provided in an inner surface side of the side cover 40R and a cut-away portion 43*b* of a hole portion 43*a* of the electrode plate 43 are engaged. The electrode plate 43 includes a contact surface 43*c* to the contact member 135, and this contact surface 43*c* faces the outside from a window hole 40*f* provided in the side cover 40R.

Then, one end portion of the urging member (coil spring) 42 is fitted and engaged with the boss portion 40*a* of the side cover 40. Further, an inside boss portion 41*b* of the electroconductive member 41 placed in a state in which it is fitted and engaged with another end portion of the urging member 42. Then, the electroconductive member 41 is pressed and moved while compressing the urging member 42 between the electrode plate 43 and the electroconductive member 41 against elasticity, so that an outer configuration portion 41*c* of the electroconductive member 41 is engaged with (into) an engaging portion 40*c* provided in an inner surface side of the side cover 40R.

The engagement of the electroconductive member 41 with the engaging portion 40*c* is effected until a claw portion 41*d* provided in the electroconductive member 41 side is engaged with a claw receiving portion 40*d* provided in the side cover 40R side. As a result, even when a hand is moved from the electroconductive member 41, the electroconductive member 41 is prevented from being disengaged from the engaging portion 40*c* irrespective of compression reaction force of the urging member 42. The electroconductive member 41 has, in a state in which it is engaged with and retained by the engaging portion 40*c*, a degree of freedom capable of further moving between itself and the side cover 40R while pressing and shortening the urging member 42 against elasticity. That is, the electroconductive member 41 is supported movably in the longitudinal direction by the side cover 40R.

In this state, the electrode plate 43 is pressed against the inner surface of the side cover 40R by the compression reaction force of the urging member 42 and at the same time, one end portion of the electroconductive urging member 42 is pushed against and contacted to the electrode plate 43 located at a position where the electrode plate 43 is engaged with the boss portion 40*a* of the side cover 40R. As a result, the electrode plate 43 and the urging member 42 are placed in an electrically conducted state. Further, also another end portion of the urging member 42 is pushed against and contacted to the inner surface of the electroconductive member 41 by the compression reaction force of the urging member 42. As a result, the urging member 42 and the electroconductive member 41 are placed in an electrically conducted state.

Center shafts of the urging member 42 and the other configuration portion 41*c* and the contact portion 41*a* of the electroconductive member 41 are disposed so as to be substantially aligned with the center of the rotation shaft of the developing roller 11 in a state in which the side cover 40R is mounted to the development side plate 19R of the developing unit 10 in one end side.

As described above, the side cover 40R in which the electrode plate 43, the urging member 42 and the electroconductive member 41 are assembled in its inner surface side is mounted on the development side plate 19R of the developing unit 10 in one end side. As a result, the driving mechanism portion M located outside the development side plate 19 is covered and the contact portion 41*a* located outside the electroconductive member 41 is contacted to the end surface 11*c* of the metal shaft 11*b* of the developing roller 11 in one end side. This contact is effected by moving the electroconductive member 41 toward the side cover R in the engaging portion 40*c* while the electroconductive member 41 presses and shortens the urging member 42.

That is, the electroconductive member 41 is a member which is supported movably in the axial direction of the metal shaft 11*b* by the side cover 40R and which is contacted to the end surface of the metal shaft 11*b* in one end side, and the urging member 42 moves and urges the metal shaft 11*b* via the electroconductive member 41 from one end side to another end side. That is, the metal shaft 11*b* of the developing roller 11 is moved and urged from one end side to another end side in an arrow K direction via the electroconductive member 41 by the compression reaction force of the urging member 42. As a result, the developing roller 11 is moved in the K direction, so that the stepped portion 11*e* runs against the receiving surface 19*a* of the development side plate 19L.

Further, the stepped portion 11*e* of the metal shaft 11*b* is received by the receiving surface 19, as an abutting portion, of the development side plate 19L by the urging force of the urging member 42, so that position of the developing roller 11 with respect to the axial direction is made. Further, the urging force of the urging member 42 ensures a contact (point) pressure between the electroconductive member 41 and the developing roller 11. Thus, the contact pressure of the electroconductive member 41 for permitting bias application to the developing roller 11 can be used as the urging force of the urging member 42 for urging the developing roller 11 in one direction of the longitudinal direction.

In this embodiment, the electrode plate 43 is formed of a metal plate material, the urging member 42 is formed with the compression spring of a metal wire material, and the electroconductive member 41 is formed with an electroconductive resin member. Each of these members 43, 42 and 41 constitutes a part of an electroconductive path for permitting developing bias application.

When the cartridge P is mounted in the apparatus main assembly 100A, the contact member 135 of the apparatus main assembly 100A contacts the contact surface 43*c* of the electrode plate 43. Thus, the developing bias can be applied from the electrode plate 43 to the developing roller 11 via the urging member 42 and the contact portion 41*a* of the electroconductive member 41 which are electroconductive.

That is, in this embodiment, the electroconductive electrode plate 43, the urging member 42 and the electroconductive member 41 constitute the electroconductive path for electrically connecting the metal shaft 11*b* and the contact member 135 provided in the apparatus main assembly 100A side when the cartridge P is mounted in the apparatus main assembly 100A. Each of the electrode plate 43, the urging member 42 and the electroconductive member 41 constitutes a part of the electroconductive path.

Here, the electroconductive member 41 includes the contact portion 41*a* contactable to the end surface 11*c* of the metal shaft 11*b* at a portion other than a rotation center portion 11*d* of the end surface 11*c* of the metal shaft 11*b*. In this embodiment, the contact portion 41*a* of the electroconductive member 41 contactable to the developing roller 11 has a hollow cylindrical shape 41*g* having an inner diameter H1 larger than that of a residual protrusion which is the rotation center portion 11*d* of the end surface 11*c* of the metal shaft 11*b*, and having an outer diameter H2.

By employing such shape, even when the residual protrusion 11*d* is left on the end surface 11*c* of the metal shaft 11*b*, the protrusion 11*d* is not contacted to the contact portion 41*a* of the electroconductive member 41. Therefore, even when removal machining (processing) of the protrusion 11*d* of the metal shaft end surface 11*c* is not effected, the contact portion 41*a* and the metal shaft end surface 11*c* can be contacted to each other at a flat surface portion, so that stable bias application can be effected.

Incidentally, in this embodiment, the shape of the contact portion 41*a* of the electroconductive member 41 is the hollow cylindrical shape 41*g* provided at a portion other than the protrusion 11*d* of the metal shaft end surface 11*c* of the developing roller 11 but may also be a non-cylindrical shape if the shape is such that it avoids the protrusion 11*d*. For example, even when the shape is such that a part of the cylinder is cut (e.g., a C-character shape) or such that the contact portion 41*a* of the electroconductive member 41 is provided with a plurality of projections 41*e* as shown in FIG. 8, it becomes possible to obtain an effect similar to that in the case of the hollow cylindrical shape.

(Embodiment 2)

Figure 9:
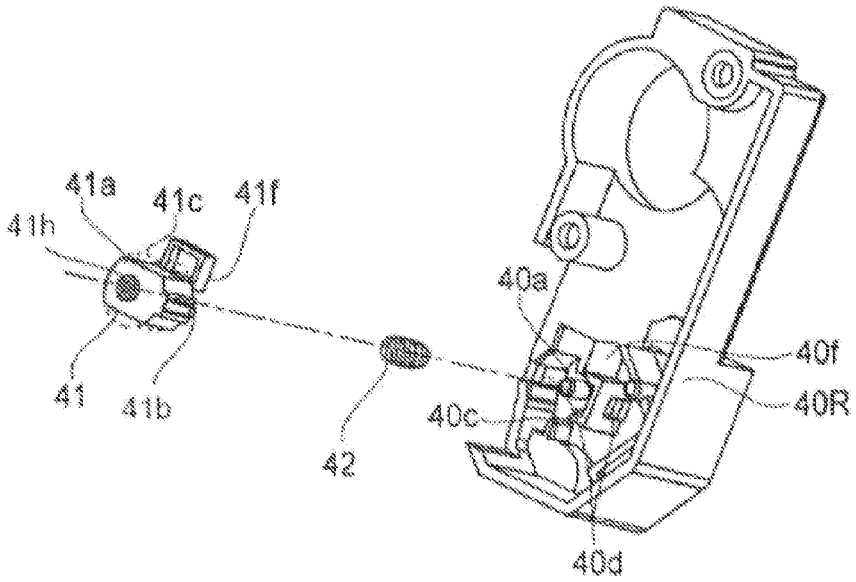
FIG. 9 is an exploded perspective view of a side cover, an electroconductive member and an urging member in Embodiment 2.
Figure 10:
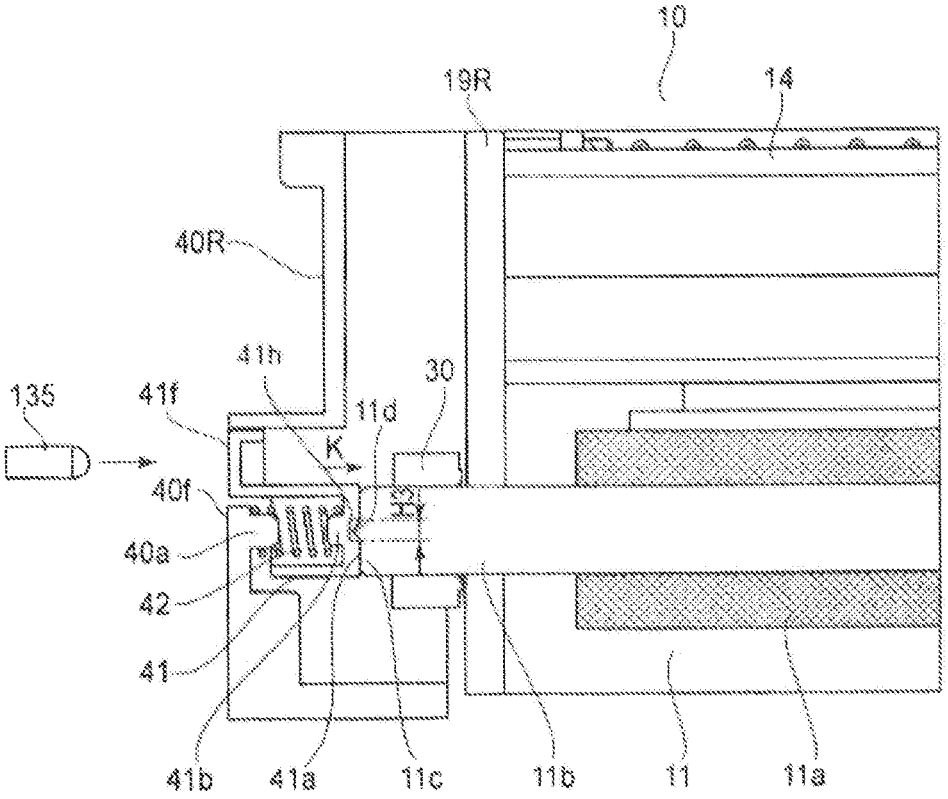
FIG. 10 is a partially sectional view, of a developing unit, showing a developing roller in one end side (driving side).

Next, another embodiment according to the present invention will be described with reference to FIGS. 9 and 10. Incidentally, basic constitutions of the cartridge and the image forming apparatus in this embodiment are the same as those in Embodiment 1. Therefore, elements having functions and constitutions identical or corresponding to those in Embodiment 1 are represented by the same reference numerals or symbols and will be omitted from detailed description. FIG. 9 is an exploded perspective view of the side cover 40R, the electroconductive member 41 and the urging member 42 in this embodiment. FIG. 10 is a partially sectional view, of the developing unit 10, showing the developing roller 11 in one end side (driving side).

Also in this embodiment, outside the development side plate 19R of the developing unit 10, the side cover 40R is mounted. Further, inside the side cover 40R, the electroconductive member 41 formed with the electroconductive resin member and the urging member 42 are mounted.

The electroconductive member 41 includes a contact surface 41*f* to the contact member 135, and this contact surface 41*f* faces the outside from a window hole 40*f* provided in the side cover 40R. Further, the electroconductive member 41 includes a spring supporting portion 41*b* and a recessed portion 41*h*. The recessed portion 41*h* is substantially aligned with the center of the rotation shaft of the developing roller 11 and has a hole shape having a diameter H3 lager than that of the protrusion 11*d* which is the rotation center portion of the metal shaft end surface 11*c*.

One end portion of the urging member (coil spring) 42 is fitted and engaged with the boss portion 40*a* of the side cover 40. Further, an inside boss portion 41*b* of the electroconductive member 41 placed in a state in which it is fitted and engaged with another end portion of the urging member 42. Then, the electroconductive member 41 is pressed and moved while compressing the urging member 42 between the inner surface of the side cover 40R and the electroconductive member 41 against elasticity, so that an outer configuration portion 41*c* of the electroconductive member 41 is engaged with (into) an engaging portion 40*c* provided in an inner surface side of the side cover 40R.

The engagement of the electroconductive member 41 with the engaging portion 40*c* is effected until a claw portion 41*d* provided in the electroconductive member 41 side is engaged with a claw receiving portion 40*d* provided in the side cover 40R side. As a result, even when a hand is moved from the electroconductive member 41, the electroconductive member 41 is prevented from being disengaged from the engaging portion 40*c* irrespective of compression reaction force of the urging member 42. The electroconductive member 41 has, in a state in which it is engaged with and retained by the engaging portion 40*c*, a degree of freedom capable of further moving between itself and the side cover 40R while pressing and shortening the urging member 42 against elasticity. That is, the electroconductive member 41 is supported movably in the longitudinal direction by the side cover 40R.

By doing so, also in the case of Embodiment 2, similarly as in Embodiment 1, when the side cover 40R is mounted on the development side plate 19R of the developing unit 10, the contact surface 41*a* can be press-contacted to the metal shaft end surface 11*c* of the developing roller 11. Together with this, the protrusion 11*d* can be avoided by the recessed portion 41*h* provided at the contact surface 41*a*.

When the cartridge P is mounted in the apparatus main assembly 100A, the contact member 135 of the apparatus main assembly 100A contacts the contacts the contact surface 41*f* of the electroconductive member 41. Thus, the developing bias can be applied to the developing roller 11 via the contact portion 41*a* of the electroconductive member 41. In this embodiment, the electroconductive member 41 constitutes, when the cartridge P is mounted in the apparatus main assembly 100A, the electroconductive path for electrically connecting the metal shaft 11*b* and the contact member 135 provided in the apparatus main assembly 100A side.

Also in this embodiment, similarly as in Embodiment 1, the metal shaft 11*b* of the developing roller 11 is moved and urged in an arrow K direction from one end side to another end side via the electroconductive member 41 by the compression reaction force of the urging member 42. As a result, the developing roller 11 is moved in the K direction, so that the stepped portion 11*e* (FIG. 7) runs against the receiving surface 19*a* of the development side plate 19L.

That is, the stepped portion 11*e* of the metal shaft 11*b* is received by the receiving surface 19, as an abutting portion, of the development side plate 19L by the urging force of the urging member 42, so that position of the developing roller 11 with respect to the axial direction is made. Further, the urging force of the urging member 42 ensures a contact (point) pressure between the electroconductive member 41 and the developing roller 11. Thus, the contact pressure of the electroconductive member 41 for permitting bias application to the developing roller 11 can be used as the urging force of the urging member 42 for urging the developing roller 11 in one direction of the longitudinal direction.

Further, even when the residual protrusion 11*d* is left on the rotation shaft portion of the metal shaft end surface 11*c*, the protrusion 11*d* is not contacted to the contact portion 41*a* of the electroconductive member 41. Therefore, even when removal machining (processing) of the protrusion 11*d* of the metal shaft end surface 11*c* is not effected, the contact portion 41*a* and the metal shaft end surface 11*c* can be contacted to each other at a flat surface portion, so that stable bias application can be effected.

Further, the electroconductive member 41 is integrally provided with the contact surface 41*f* to the contact member 135 of the apparatus main assembly 100A, so that the number of parts can be reduced.

(Other Embodiments)

(1) In Embodiments 1 and 2, the contact constitution of the bias application to the developing roller 11 and the urging constitution in the longitudinal direction are described but as another embodiment, similar constitutions may also be employed for the charging roller 3, the supplying roller 12 or the like. That is, it is possible to employ the similar constitutions for a rotatable member which is supported rotatably by the frame constituting the framework of the cartridge and movably in the axial direction and which has the metal shaft to which the bias is to be applied.

(2) In the present invention, the cartridge is detachably mountable to the apparatus main assembly of the image forming apparatus. Further, the cartridge includes the frame constituting the framework of the cartridge and includes a rotatable member which is supported rotatably by the frame and movably in the axial direction and which has the metal shaft to which the bias is to be applied. Examples of the cartridge may include the integral type process cartridge, the discrete type process cartridge, the developing cartridge, and the like.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 192528/2011 filed Sep. 5, 2011, which is hereby incorporated by reference.

What is claimed is:

1. A cartridge detachably mountable to a main assembly of an image forming apparatus for forming an image on a recording material, said cartridge comprising:

a rotatable member including a metal shaft, said rotatable member being supported rotatably and movably an axial direction of said metal shaft by a frame, wherein a bias is to be applied to said metal shaft;

an electroconductive member, supported movably in the axial direction of said metal shaft, said electroconductive member being in contact to an end surface of said metal shaft at one end side of said metal shaft for constituting at least a part of an electroconductive path for electrically connecting said metal shaft and a contact member provided in the main assembly when said cartridge is mounted in the main assembly; and an urging portion for urging said metal shaft via said electroconductive member in a direction from the one end side to another end side of said metal shaft, wherein said electroconductive member includes a contact portion where said electroconductive member is contacted to said end surface of said metal shaft at a portion other than a rotation center portion of said metal shaft at said end surface, and wherein said contact portion has a hollow shape at said rotation center portion of said metal shaft at said end surface such that said contact portion does not contact a center portion of said metal shaft at said end surface.

2. A cartridge according to claim 1, wherein said contact portion of said electroconductive member has a hollow cylindrical shape at said portion other than said rotation center portion of said metal shaft at said end surface.

3. A cartridge according to claim 1, wherein said electroconductive member is formed of an electroconductive resin member.

4. A cartridge according to claim 1, wherein said rotatable member is a developing roller for carrying a developer and for developing a latent image by being supplied with a developing bias.

5. A cartridge according to claim 1, wherein said rotatable member is a charging roller for electrically charging an image bearing member by being supplied with a charging bias.

6. An cartridge according to claim 1, further comprising:

a rotatable image bearing member on which a latent image is to be formed; and as said rotatable member, a developing roller for carrying a developer and for developing the latent image on said image bearing member by being supplied with a developing bias.

7. A cartridge according to claim 1, further comprising:

a rotatable image bearing member on which a latent image is to be formed; and as said rotatable member, a charging roller for electrically charging said image bearing member by being supplied with a charging bias.

8. An image forming apparatus, comprising:

a cartridge according to claim 1; and said contact member provided in a main assembly of said image forming apparatus.

9. cartridge according to claim 1, further comprising:

an abutting portion for positioning said rotatable member with respect to the axial direction by being abutted by another end side of said metal shaft by an urging force of said urging member.

10. A cartridge detachably mountable to a main assembly of an image forming apparatus for forming an image on a recording material, said cartridge comprising:

a rotatable member including a metal shaft, said rotatable member being supported rotatably and movably in an axial direction of said metal shaft by a frame, wherein a bias is to be applied to said metal shaft;

an electroconductive member, supported movably in the axial direction of said metal shaft, said electroconductive member in contact to an end surface of said metal shaft at one end side of said metal shaft for constituting at least a part of an electroconductive path for electrically connecting said metal shaft and a contact member provided in the main assembly when said cartridge is mounted in the main assembly; and an urging portion for urging said metal shaft via said electroconductive member in a direction from the one end side to another end side of said metal shaft, wherein said electroconductive member includes a contact portion where said electroconductive member is contacted to said end surface of said metal shaft at a portion other than a rotation center portion of said metal shaft at said end surface, and wherein said contact portion is a plurality of projections provided at positions other than said rotation center portion of said metal shaft at said end surface such that said contact portion does not contact a center portion of said metal shaft at said end surface.

11. A cartridge according to claim 10, wherein said electroconductive member is formed of an electroconductive resin member.

12. A cartridge according to claim 10, wherein said rotatable member is a developing roller for carrying a developer and for developing a latent image by being supplied with a developing bias.

13. A cartridge according to claim 10, wherein said rotatable member is a charging roller for electrically charging an image bearing member by being supplied with a charging bias.

14. An cartridge according to claim 10, further comprising:

a rotatable image bearing member on which a latent image is to be formed; and as said rotatable member, a developing roller for carrying a developer and for developing the latent image on said image bearing member by being supplied with a developing bias.

15. A cartridge according to claim 10, further comprising:

a rotatable image bearing member on which a latent image is to be formed; and as said rotatable member, a charging roller for electrically charging said image bearing member by being supplied with a charging bias.

16. An image forming apparatus, comprising:

a cartridge according to claim 10; and said contact member provided in a main assembly of said image forming apparatus.

17. A cartridge according to claim 10, further comprising:

an abutting portion for positioning said rotatable member with respect to the axial direction by being abutted by another end side of said metal shaft by an urging force of said urging member.

* * * * *